United States Patent [19]

John

[11] 4,408,663

[45] Oct. 11, 1983

[54] PROCESS FOR ENLARGEMENT OF ROCK FRACTURES

[76] Inventor: Peter W. John, An der Wedel 5, 3006 Burgwedel 1, Fed. Rep. of Germany

[21] Appl. No.: 300,544

[22] Filed: Sep. 9, 1981

[30] Foreign Application Priority Data

Oct. 6, 1980 [DE] Fed. Rep. of Germany ..... 3037807

[51] Int. Cl.[3] ..... E21B 43/263; E21B 43/267

[52] U.S. Cl. ..... 166/259; 166/299; 166/280; 166/250

[58] Field of Search ..... 166/259, 299, 63, 308, 166/280; 299/13; 175/2; 102/301, 332; 86/20 C

[56] References Cited

U.S. PATENT DOCUMENTS

| | | | |
|---|---|---|---|
| 3,066,733 | 12/1962 | Brandon | 166/299 |
| 3,630,279 | 12/1971 | Fask et al. | 166/299 |
| 3,674,089 | 7/1972 | Moore | 166/299 |
| 3,690,106 | 9/1972 | Tregembo et al. | 166/299 |
| 3,713,487 | 1/1973 | Lozanski | 166/299 |
| 3,990,512 | 11/1976 | Kuris | 166/299 |
| 4,030,549 | 6/1977 | Bouck | 166/302 |
| 4,039,030 | 8/1977 | Godfrey et al. | 166/299 |

*Primary Examiner*—Stephen J. Novosad
*Assistant Examiner*—Joseph Falk
*Attorney, Agent, or Firm*—Pollock, Vande Sande & Priddy

[57] ABSTRACT

A process for enlarging or widening rock fractures in order to facilitate the recovery of deposits, such as oil or gas, comprising the emplacement of an aluminothermic mixture of aluminum and ferric oxide, and its subsequent ignition. Preferably, slag-forming products are also placed into the cavity, so as to prevent closure of the fractures after termination of the combustion process.

8 Claims, No Drawings

PROCESS FOR ENLARGEMENT OF ROCK FRACTURES

SUMMARY OF THE INVENTION

The present invention relates to a process for the enlargement of rock fractures, wherein an aluminothermic mixture of aluminum and ferric oxide is placed into the cavity and ignited.

BACKGROUND OF THE INVENTION

It is well known to create rock fractures artificially by introducing a fluid under high pressure for the purpose of disclosing gas- or oil-bearing rock formations. To prevent re-closure of such fractures it is known to pump retaining means into the fractures, which after release of the pressure on the fractures producing fluid, keep the fissure in at least partly open condition, so that gas or a fluid such as crude oil can flow through the fractures to a bore hole. However, since resistance to flow is especially pronounced in the case of extended fractures, the length of such fractures should not exceed a certain optimum. To produce uniform disclosure, bore holes must be arranged rather close to one another, with the result that costs are considerably increased.

These disadvantages become especially noticeable where in situ gasification of coal or oil is required, either because mining of the coal is uneconomical or because the oil cannot be transported because of its high viscosity.

In the case of such in situ gasification, a basic prerequisite is the supply of oxygen to the combustion zone through an artificially created fractures (if the initial permeability of a coal seam or of a pay zone is insufficient), and the simultaneous recovery of the gas produced by the partial combustion, also through the fracture.

In view of these requirements, it has already been attempted to link two bore holes by a fracture, so that one hole could be used for oxygen supply and the other for gas recovery. However, even when the distance between the holes is small, e.g., 50 m, it is difficult to achieve accurate linkage between them. Moreover, the application of heat, steam, injection of hot water or chemical solvents, in situ combustion or gasification for improved hydrocarbon recovery, especially in low permeability formations or coal seams, requires prior preparation, which can be achieved by straightforward or advanced processes (see, e.g., U.S. Pat. No. 3,933,205).

Attempts have also been made to disclose subterranean formations by means of explosives. German Published Application No. 1 962 260 describes a process for breaking open a gas or oil reservoir disclosed by a production probe in which slurry of high force explosive is placed into the seam and is detonated. The explosive is located only in the bore hole, so that the effect of the detonation is restricted to a limited area immediately around the bore hole. Such a process is not suitable for the extension of a fracture because the amounts of explosive which can be placed into a fracture are too small, and the surrounding rock is too inert to permit permanent enlargement of a rock fracture. Even if such an enlargement were produced, it would be only temporary, since the rock pressure would promptly re-seal the fracture.

German Pat. No. 512,955 discloses an explosion process in which an aluminothermic mixture within a waterproofed casing is placed in a bore hole, water being arranged around the casing. After ignition of the aluminothermic mixture, great heat is released, causing the surrounding water to evaporate and superheat. The resulting vapor pressure causes scattering of the bore hole walls. This known explosion process is not suitable for enlargement of rock cavities such as rock fractures, because in this case the main objective is not the destruction of the fracture walls, but rather enlargement of the fracture width. In addition, the known explosion process is limited to shallow depths.

OBJECT OF THE INVENTION

The object of the invention is a process for the widening of rock fractures which facilitates effective, permanent and economically feasible enlargement of even relatively long fractures. This object is attained by emplacing in the rock fracture to be widened a mixture of aluminum and ferric oxide in a grain size suitable for pumping.

DESCRIPTION OF PREFERRED EMBODIMENT

In the process according to the invention, an extremely high temperature, e.g., 3000° C., is created for a short duration by the reaction of the aluminothermic mixture, which causes by thermal stresses the creation of cracks at the fracture faces, so that total permeability is increased. In addition sinter ceramics are created, which prevent fracture closure after termination of the combustion process. During combustion, gas pressure is produced, particularly if coal or oil located in the fracture is gasified simultaneously. This gas pressure causes channeling to the exit bore hole, which channeling is of a permanent character due to the bursting pressure of the resulting sinter ceramic products. Moreover, the gas pressure causes expulsion of the fluid used for the original creation of the fracture and for the sludging of the aluminothermic mixture. This is of particular advantage, because often the in situ reservoir pressure is not sufficient to clean up the fracture, especially the narrow areas thereof, in which it is without effect. Gasification also causes a decrease in volume which contributes further to widening of the fracture.

In order to obtain the largest possible creation of sinter ceramics, and thereby retention of the extended fracture, it is suitable to emplace ceramic materials suited for sintering together with the aluminothermic mixture and/or to introduce an aluminothermic mixture with sinter forming materials and preferably oxygen releasing constituents. The aluminothermic mixture can be pumped or placed by a fluid, foamed fluid or gas. The fluid is expected to be under high pressure and thus to serve as a means for creation and/or extension of a rock fracture.

In a further embodiment of the process, small detonation bodies spaced from one another are emplaced together with the aluminothermic mixture. The introduction of small detonation bodies is known per se from German Pat. No. 2,702,622. This arrangement can be used with the present invention too, in order to localize the combustion front in space and time, and in particular the azimuth of the fracture, by recording of the seismic signals fron the single detonations at the moment when the combustion front passes a small body.

The placement and burning of an aluminothermic mixture may be repeated one or several times, to enlarge the hydraulic flow cross section and to prop the fracture by sintering of the adjacent ceramic material. It is also possible after the burning of the aluminothermic mixture to pump in fluid again, in order to achieve enlargement of the fracture, preferably to improve the emplacement of the repeated introduction of aluminothermic mixture. Concurrently an extension of the fracture, which may be considerable, can be achieved if the indicated process is used several times. Such long fractures or fracture systems are usable despite their extended lengths over the entire created extension due to the application of the process according to the invention, and only one bore hole is necessary for their creation. If in situ gasification is desired, it is merely necessary to drill one bore hole at the end of the fracture or fracture system extended and enlarged according to the invention, which hole can be placed by use of the aforementioned detonation bodies and the seismically determined location facilitated thereby. Thus, for the creation of fractures, e.g., in coal seams, two bore holes close to each other are no longer necessary but only one in the first instance; the other may be located after formation and enlargement of the fracture at the seismically determined tip. Hence, the cost of an in situ gasification project can be significantly reduced by use of the invention, and its efficiency can be increased.

A further development of the process according to the invention comprises the emplacement, subsequent to the burning down of the aluminothermic mixture, of blocking agents, which, with or without time limitation, block a part of the fracture, whereupon, starting from the previous fracture, additional fractures are created by pumping in of fluid, the mixture then being placed into these additional fractures. By this further development, in addition to an enlargement of the fracture, lateral branching or diversion of the fracture can be achieved, so that the formation can be penetrated further by controlled direction or splitting of the fracture. Combined with this procedure, aluminothermic mixtures can then be placed advantageously into the created lateral cracks and branches and preferentially only into these, followed by ignition.

EXAMPLE

A bore hole is drilled down into a deep, normally unminable coal seam. Fluid is then pumped in under high pressure and a fracture is created emanating from the bore hole in the coal seam. Following the creation of the fracture, an aluminothermic powder mixture of pumpable grain size is added to the fluid or pumped down by means of a carrier fluid, which prevents any degradation of the aluminothermic mixture components. In addition, small detonation bodies, e.g., as disclosed in German Pat. No. 2,702,622, are added periodically. The pumping or placing operation continues until the fracture is packed with a layer of the mixture of sufficient thickness. This layer is ignited, so that an exothermic reaction occurs, generally according to the reaction equation $$2Al + Fe_2O_3 \rightarrow 2Fe + Al_2O_3 + 764\ kJ$$

This reaction produces temperatures of up to 3000° C., which act upon the confining fracture wall. The result is a thermically caused enlargement as well as the creation of sinter ceramic by-products, which prop the fracture open.

As the combustion front advances, the jointly pumped and placed single detonation bodies are reached and ignited sequentially, the location of the detonations being determinable by seismic measurements. The speed of advance of the combustion front as well as the exact azimuth and geometry of the fracture and especially the extension of the latter from tip to tip can be determined in this way. After the combustion front has reached the tip of the fracture (the retainer placement tip), a bore hole is drilled at this location on the fracture tip. Then the in situ gasification process is started by supplying oxygen, e.g, by injection of air into one of the bore holes and recovery of the corresponding generated gas from the other bore hole.

What is claimed is:

1. Process for the controlled enlargement of a rock fracture, comprising the steps of (a) placing an aluminothermic mixture of aluminum and ferric oxide of pumpable grain size having a predetermined concentration distribution of detonation bodies spaced from one another into said fracture;

(b) introducing into said fracture a high pressure fluid which acts as a carrier to place said mixture and said distribution of detonation bodies as said fluid is pumped, whereby said fracture is created and enlarged and a detonation body distribution adapted to a characteristic signal pattern is produced; and (c) igniting said mixture.

2. A process according to claim 1, wherein slag-forming products are also placed into said cavity.

3. A process according to claim 1, wherein said mixture comprises slag-forming constituents.

4. A process according to claim 3, wherein said mixture further comprises oxygen releasing constituents.

5. A process according to claim 1, wherein said placement and ignition of said aluminothermic mixture and distributed detonation body pattern for controlled fracture extension is repeated at least once.

6. A process according to claim 1, wherein, after ignition of said mixture, the produced high reaction temperature causes enlargement of the volume of said fracture by partial combustion of hydrocarbons at the fracture faces, and generates a characteristic sequential acoustic signal pattern by ignition of said detonation bodies, whereby fracture geometry determination is facilitated.

7. A process according to claim 1, wherein the ignition of said detonating bodies proceeds sequentially.

8. A process according to claim 6, wherein after placement and combustion of said aluminothermic mixture, signal recording and fracture orientation evolution, further mixture is pumped into said fracture under high pressure.

* * * * *